US005232257A

United States Patent [19]

Koide et al.

[11] Patent Number: 5,232,257

[45] Date of Patent: Aug. 3, 1993

[54] AUTOMATIC HOOKING APPARATUS AND SHIP CARGO GEAR USING THE SAME

[75] Inventors: Kiyozou Koide, Ichihara; Kenetsu Matsukawa, Futtsu; Kenichi Nagao, Kimitsu; Yoichi Nakayama, Kitakyushu; Kunihiro Katashima; Kazuaki Saitoh, both of Kimitsu, all of Japan

[73] Assignees: Sanku Inc.; Nippon Steel Corporation, both of Japan

[21] Appl. No.: 889,912

[22] Filed: May 29, 1992

[51] Int. Cl.[5] ..... B66C 1/14; B66C 1/66

[52] U.S. Cl. ..... 294/68.3; 294/68.27; 294/81.51; 294/81.56; 294/82.31

[58] Field of Search ..... 294/68.1-68.26, 294/68.27, 68.3, 67.1, 67.3, 67.31, 75, 81.41, 81.5, 81.51, 81.56, 82.24-82.27, 82.3-82.36, 110.1, 111, 116, 122-124; 414/403, 404, 419, 422-424

[56] References Cited

U.S. PATENT DOCUMENTS

| | | | |
|---|---|---|---|
| 69,069 | 9/1867 | Brooke | 294/82.27 X |
| 250,779 | 12/1881 | Brown | 294/82.11 X |
| 1,976,014 | 10/1934 | Forsythe | 294/68.3 |
| 2,370,312 | 2/1945 | Herman | 294/82.31 |
| 2,711,921 | 6/1955 | Hoefer | 294/82.31 |
| 3,164,406 | 1/1965 | Barry | 294/81.41 X |
| 3,677,506 | 7/1972 | La Roe | 294/82.26 X |
| 4,128,267 | 12/1978 | Niblett et al. | 294/82.31 X |

*Primary Examiner*—Johnny D. Cherry

*Attorney, Agent, or Firm*—Venable, Baetjer, Howard & Civiletti

[57] ABSTRACT

A cargo suspension gear has a plurality of automatic hooking apparatuses which each can hook and unhook an object such as a trunnion on a large-size cargo receptacle charged with heavy cargo such as pig iron ingot or iron scrap pieces. Efficiency of the cargo handling work is remarkably improved by virtue of the automatic hooking and unhooking function and the use of large-size cargo receptacle. Working environment also is improved because there is no generation of dust.

2 Claims, 8 Drawing Sheets

AUTOMATIC HOOKING APPARATUS AND SHIP CARGO GEAR USING THE SAME

BACKGROUND OF THE INVENTION

1. Field of the Invention

The present invention relates to an automatic hooking apparatus for hooking and lifting an object, and also to a ship cargo handling gear suitable for use in handling heavy cargo such as pig iron ingot or iron scrap pieces between a pier and a ship alongside the pier.

2. Description of the Related Art

Handling of cargo such as pig iron ingots or iron scrap pieces has been conducted mainly by magnet-type cargo gear. Pig iron ingots or iron scrap pieces are usually transported by a vehicle such as a truck to a pier and are stacked on the pier. The pig iron ingots or iron scrap pieces are then attracted by a solenoid suspended by a wire of a crane, and the boom of the crane is swung to bring the cargo to a position above the ship's hull. The wire is then extended to lower the solenoid and the solenoid is de-energized to release the cargo. In some cases, other cargo holding means such as ropes or nets are used but the use of such means is only seldom.

The conventional cargo handling work relying upon a solenoid is quite inefficient because the amount of the scrap pieces lifted at a time is as small as one ton, due to limited attracting force of the solenoid. In addition, since the cargo is held merely by electromagnetic attracting force, it may dangerously drop due to an impact during, for example, swiveling of the boom of the crane, causing a risk of injury or damaging of the ship or loss of the cargo into the sea. Furthermore, since the cargo such as iron scrap pieces are temporarily landed on the pier from the transportation vehicle, dust is generated to deteriorate the working environment.

SUMMARY OF THE INVENTION

Accordingly, an object of the present invention is to provide an automatic hooking apparatus and a ship cargo gear which are free from the danger of accidental drop of the object or cargo and which can improve both the efficiency of the cargo handling work and working environment.

To this end, according to one aspect of the present invention, there is provided an automatic hooking apparatus, comprising: a hook portion, an arm portion integrally extending obliquely rearward from the base portion of the hook portion; a support to which the base of the hook portion is rotatably secured through a shaft, the support being adapted to be moved up and down by a lifting means; a guide secured to a frame and adapted for guiding the support during movement of the support up and down; and an arm guide adapted to be contacted by the end of the arm portion when the arm portion is moved upward together with the support moving upward along the guide, the arm guide being adapted to guide the end of the arm portion substantially horizontally so as to cause the arm portion to rotate about the shaft during further upward movement of the support.

According to another aspect of the invention, there is provided a ship cargo gear, comprising: a cargo receptacle capable of holding heavy cargo and having at least four trunnions; and a suspension gear for suspending and lifting the cargo receptacle; wherein the suspension gear includes, for each of the trunnions: a hook portion, an arm portion integrally extending obliquely rearward from the base portion of the hook portion; a support to which the base of the hook portion is rotatably secured through a shaft; a lifting means for causing the support to move up and down; a guide secured to a frame of the suspension gear and adapted for guiding the support during movement of the support up and down; and an arm guide adapted to be contacted by the end of the arm portion when the arm portion is moved upward together with the support moving upward along the guide, the arm guide being adapted to guide the end of the arm portion substantially horizontally so as to cause the arm portion to rotate about the shaft during further upward movement of the support.

In the automatic hooking apparatus of the present invention, hooking and unhooking can automatically be performed simply by lifting and lowering a hook member which integrally has a hook portion and an arm portion. Namely, when the hook member has been raised to a position where the arm portion is contacted and guided by the arm guide, the arm portion and, hence, the whole arm member is set substantially horizontally. The automatic hooking apparatus in this state is moved to a position above the object and then fixed at a suitable level, such that the hook member and the object to be hooked such as a trunnion are substantially aligned vertically. Then, the support is moved downward relative to the frame so that the hook member is rotated by the force of the gravity such that the hook portion is suspended upright to become ready for hooking. Although the hook member has been vertically aligned with the trunnion, the downward movement can be conducted without interference between the hook member and the trunnion because the hook member is swung averting from the trunnion during its downward movement. The frame is lifted in this state so that the hook portion of the hook member catches and hooks the trunnion. For unhooking the object, the frame is lowered to place the object on a platform or pallet, and the frame is further lowered slightly to enable the hook portion to be spaced downwardly from the trunnion. If the frame is lifted in this state, the hook portion will catch and hook the trunnion again. However, according to the invention, the frame is held stationary and the support alone is moved upward, so that the hook member is lifted to a position where its arm portion is engaged and guided by the arm guide, whereby the hook portion, i.e.,the hook member, is swung to horizontal position to enable the hook portion to clear the trunnion. The frame is then lifted so that the whole hooking apparatus can be lifted without any interference between the hook portion and the trunnion.

In the ship cargo gear of the present invention, the cargo receptacle receiving cargo such as iron scrap pieces is conveyed to a pier by a vehicle and is landed. The receptacle is then hooked and lifted by the cargo gear having a plurality of automatic hooking apparatuses of the type decribed. By using a large vessel as the cargo receptor, it is possible to increase the amount of the cargo handled at a time, thus remarkably improving the efficiency of the cargo handling work. In addition, risk of accidental dropping of the cargo such as iron scrap pieces is avoided because the scrap pieces are held in the receptacle rather than being magnetically attracted by a solenoid. Furthermore, generation of dust is prevented because there is no need for temporarily placing the cargo such as iron scrap pieces on the pier.

Figure 1:
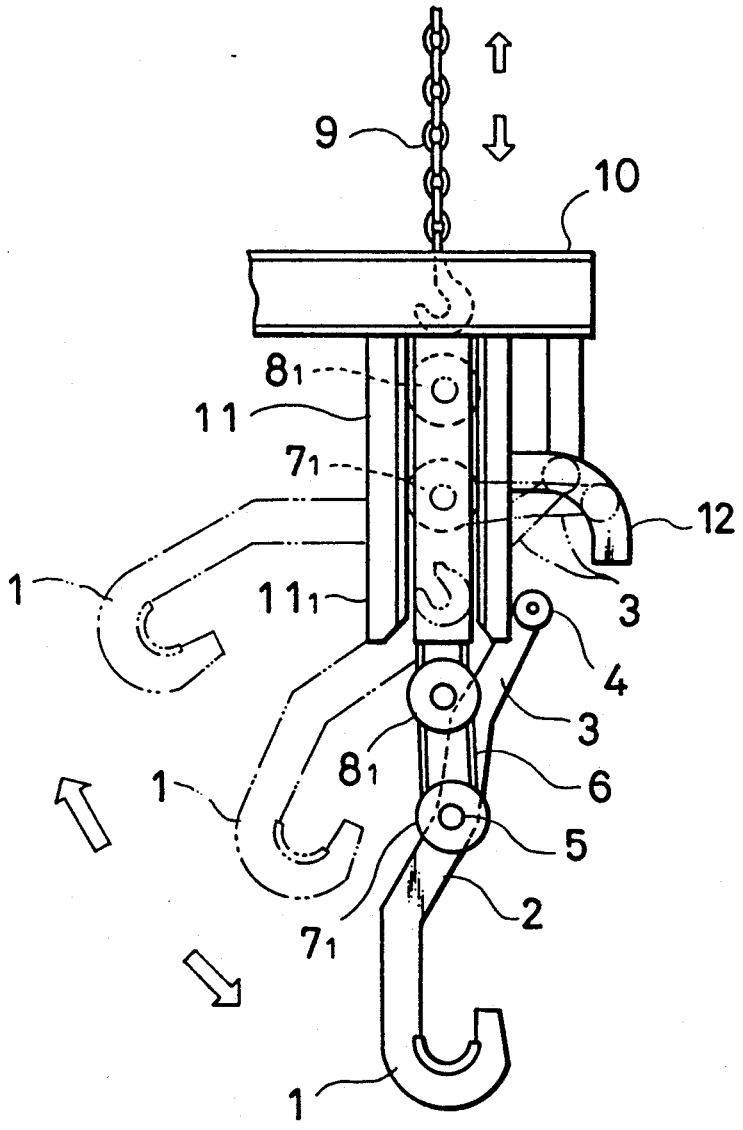
FIG. 1 is a front elevational view of an embodiment of the automatic hooking apparatus in accordance with the present invention.
Figure 2:
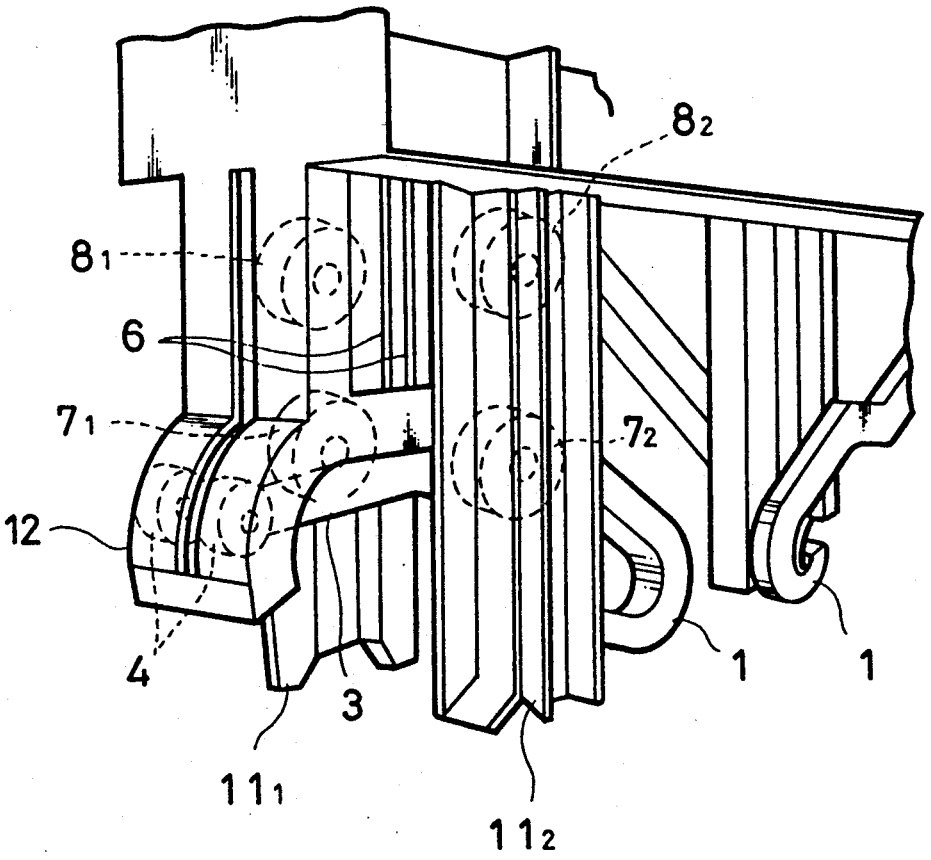
FIG. 2 is a perspective view of the hooking apparatus shown in FIG. 2.
Figure 3A:
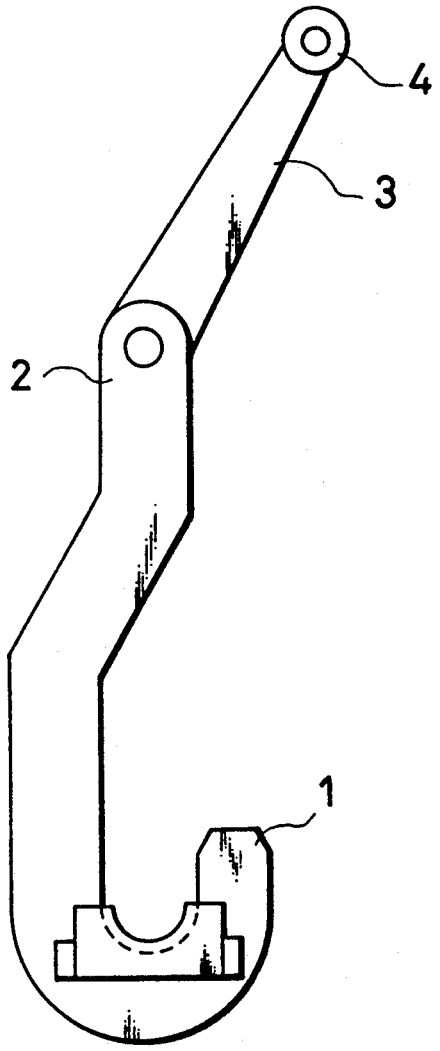
FIGS. 3*a*, 3*b* and 3*c* are a front elevational view, a side elevational view and a plan view of a hook, respectively.
Figure 3B:
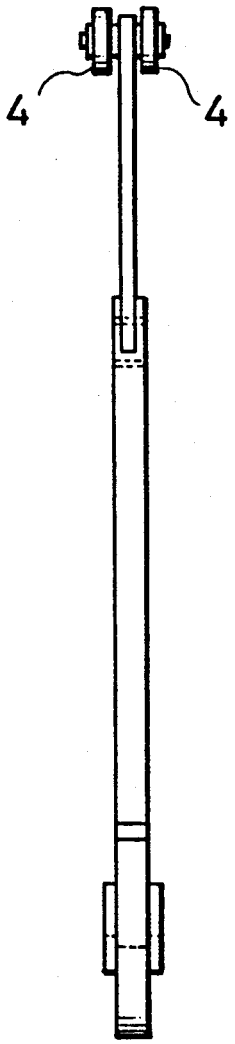
Figure 3C:
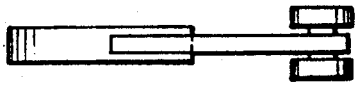

DESCRIPTION OF THE PREFERRED EMBODIMENTS:

Referring to FIG. 1, an automatic hooking apparatus embodying the present invention has a hook member having a hook portion 1, a base portion 2 and an arm portion 3 which extends obliquely rearward from the base portion 2. In this embodiment, the hook portion 1 and the arm portion 3 are formed as separate members and then integrated at their base portions so as to form the hook member. The hook portion 1 and the arm portion 3, however, may be formed integrally with each other. A pair of rollers 4 are carried by the free end of the arm portion 3. The base portion 2 of the hook member is rotatably supported by a lower portion of a support 6 through a shaft 5. Pairs of wheels $7_1$, $7_2$ and $8_1$, $8_2$ are provided on the lower end of the support 6 where the shaft 5 is provided and on the upper end of the support 6, respectively. The support 6 is suspended from a chain block 9 which forms a lifting gear and which is attached to a frame 10. A guide 11 is attached to the frame 10 so as to guide the support 6 when the latter moves up and down. The guide 11 includes a pair of opposing guide members $11_1$, $11_2$ which are arranged on both sides of the hook portion 1 with a gap corresponding to the diameters of the pairs of wheels $7_1$, $7_2$, $8_1$ and $8_2$. The guide members $11_1$ and $11_2$ have U-shaped grooves which form a passage for the support 6. The arrangement is such that the support 6 smoothly moves up and down along the guide 11 as the wheels $7_1$, $7_2$, $8_1$ and $8_2$ roll along the guide members. The frame 10 also is provided with an arm guide 12. The arrangement is such that, as the hook member is moved upward together with the support 6 along the guide 11, the rollers 4 on the end of the arm portion 3 of the hook member are brought into contact with the arm guide 12 so that a further lifting of the hook member causes the rollers 4 to roll substantially horizontally along the arm guide 12, whereby the arm portion 3 and, hence, the hook portion 1 integral therewith are rotated about the shaft 5.

When the chain block 9 operates to lower the support 6 to a lower position, the hook member is held in such a position that the hook portion 1 thereof is suspended vertically as illustrated by solid line in FIG. 1, due to the force of gravity. In this state, it is possible to hook and lift a cargo by lifting the frame 10. As the support 6 is raised relative to the frame 10 from the position shown by solid line in FIG. 1, the hook member is forcibly turned sideways as the end of the arm portion 3 is stopped and guided by the arm guide 12, so that the hook member is swung a indicated by chain lines. It is thus possible to unhook the cargo without difficulty.

Figure 4:
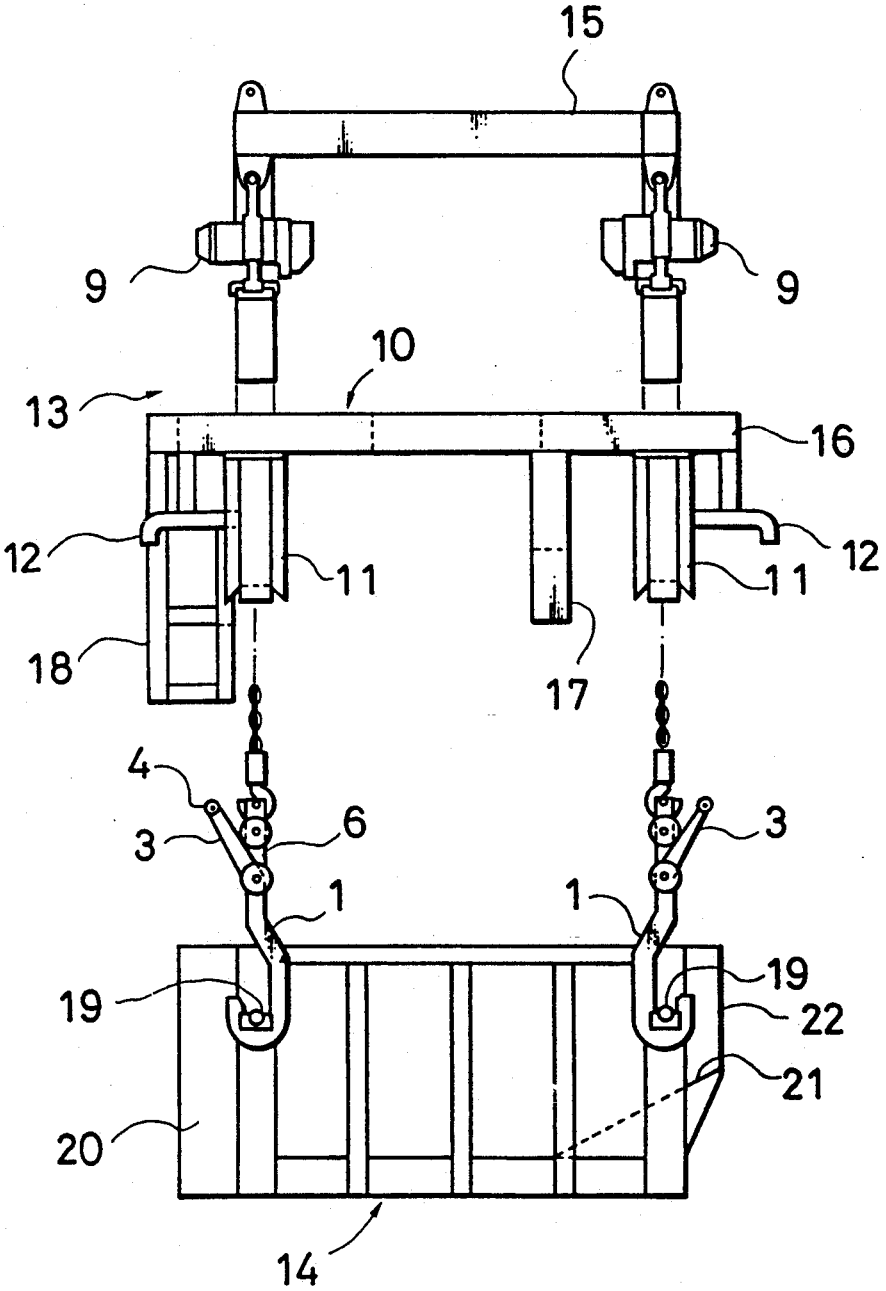
FIG. 4 is a front elevational view of an embodiment of the ship cargo gear in accordance with the present invention.
Figure 5:
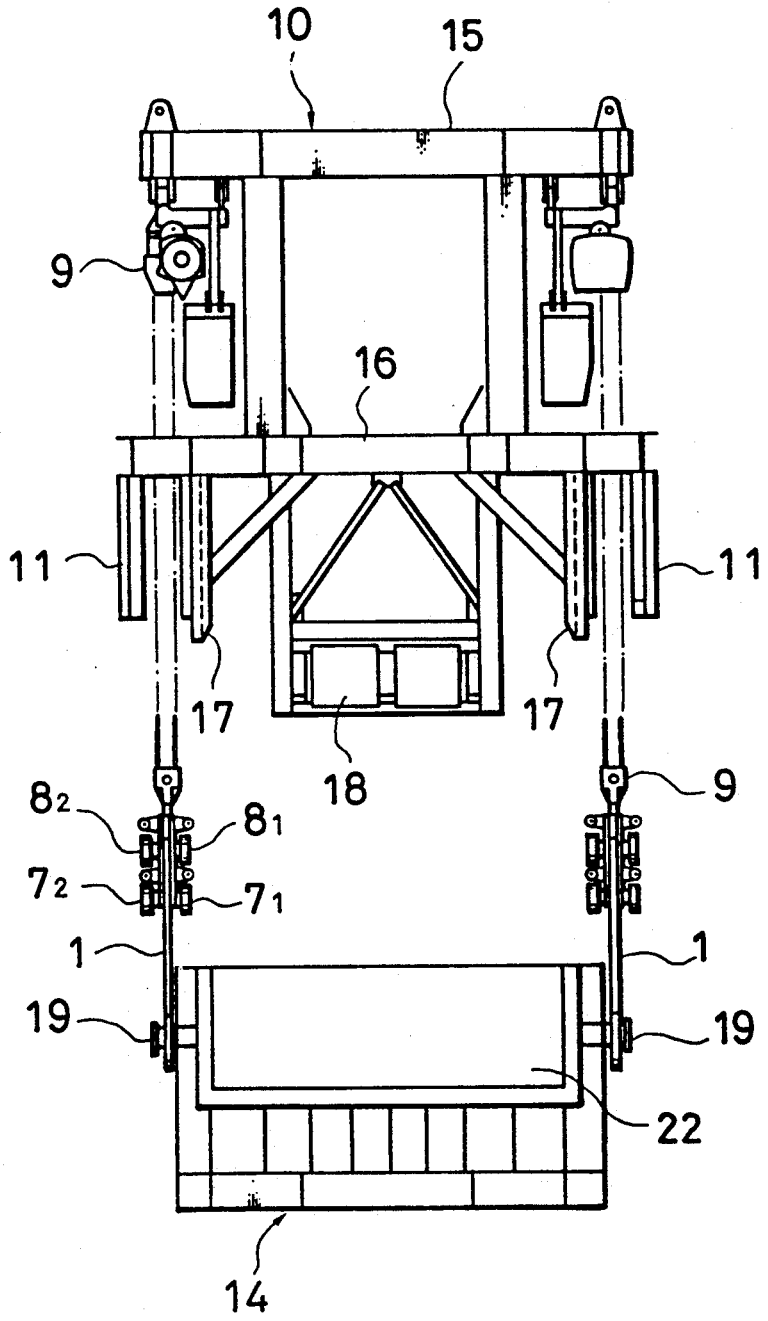
FIG. 5 is a side elevational view of the ship cargo gear of FIG. 4.
Figure 6:
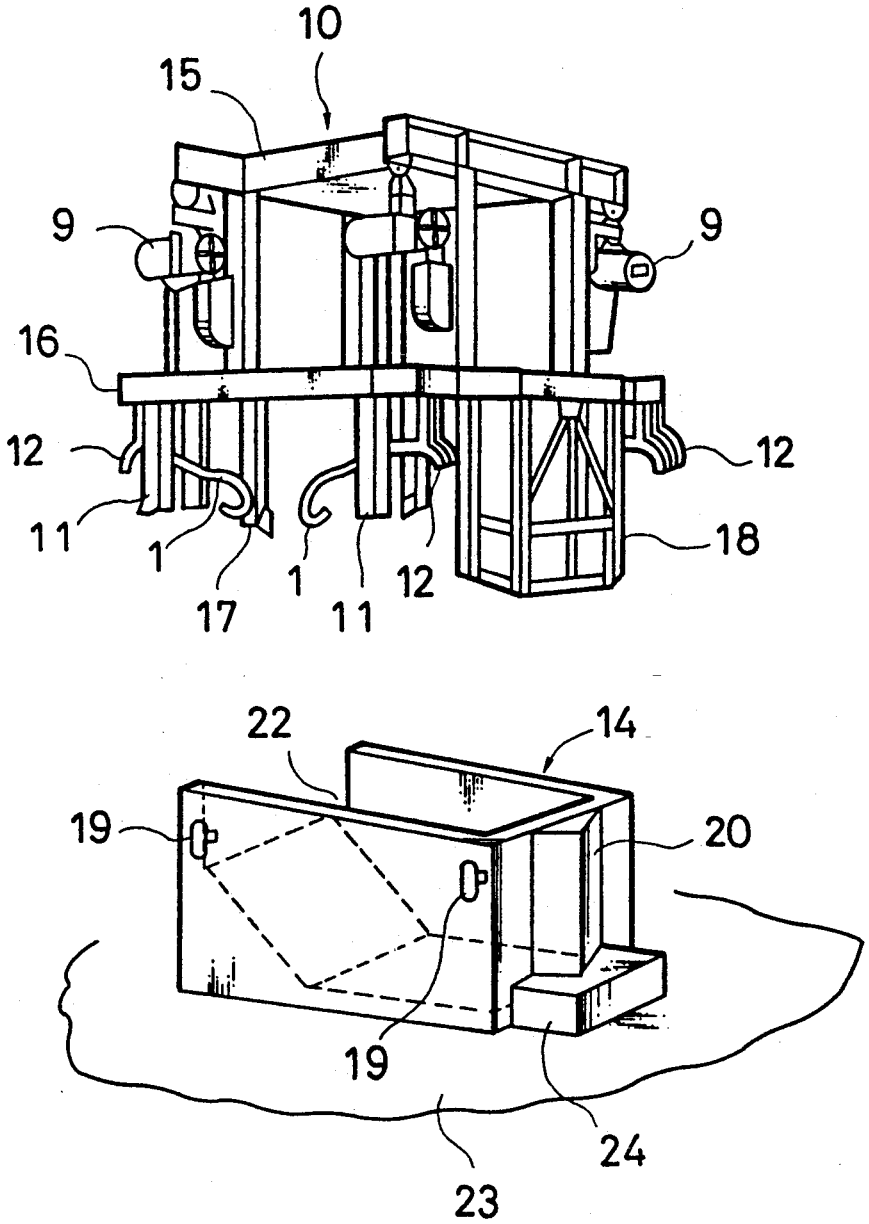
FIG. 6 is a perspective view of the ship cargo gear with a hook in released state.

FIG. 4 is a front elevational view of a ship cargo gear in accordance with the present invention, while FIG. 5 is a side elevational view of the same. FIG. 6 shows the cargo gear in unhooking state. Basically, the cargo gear has a suspension gear denoted generally by 13 and a cargo receptacle generally denoted by 14. The suspension gear 13 has a construction which is basically the same as that of the automatic hooking apparatus described before. More specifically, the suspension gear 13 has a frame 10 including an upper frame 15 to which chain blocks 9 are secured and a lower frame 16 from which the guides 11 and arm guides 12 suspend. A supporting post 17 extends downward from the lower frame 16. The amount of downward projection of the support post 17 determines the position of the frame 10 with respect to the cargo when the hook portion 1 is in an unhooking position. A suspension gear guide 18 is provided on one end of the lower frame 16. This guide 18 is intended for correctly locating the suspension gear 13 with respect to the cargo, and has a concaved locating surface.

The cargo receptacle 14 is a large-sized vessel which can hold, for example, about 8 tons of iron scrap pieces-,and is provided with four trunnions, two on the front side as illustrated and two on the rear side (not shown), at positions corresponding to the hook portions 1 of the suspension gear 13. A box guide 20 is provided on one side surface of the cargo receptacle 14 at a position corresponding to the suspension gear guide 18 mentioned before. The box guide 20 cooperates with the suspension gear guide 18 for locating the suspension gear with respect to the cargo receptacle,and has an outwardly convexed guide surface. The bottom of the cargo receptacle 14 is inclined at one lateral side of the receptacle as denoted by 21 and the receptacle wall above the portion 21 of the bottom is omitted so that the cargo receptacle can discharge its content when tilted. In FIG. 6, the cargo receptacle 14 is carried by a pallet 23 which can be conveyed by a vehicle. The pallet 23 has a stopper guide 24 which makes surface contact with the box guide 20 so as to correctly locate the cargo receptacle 14 on the pallet 23.

Figure 7:
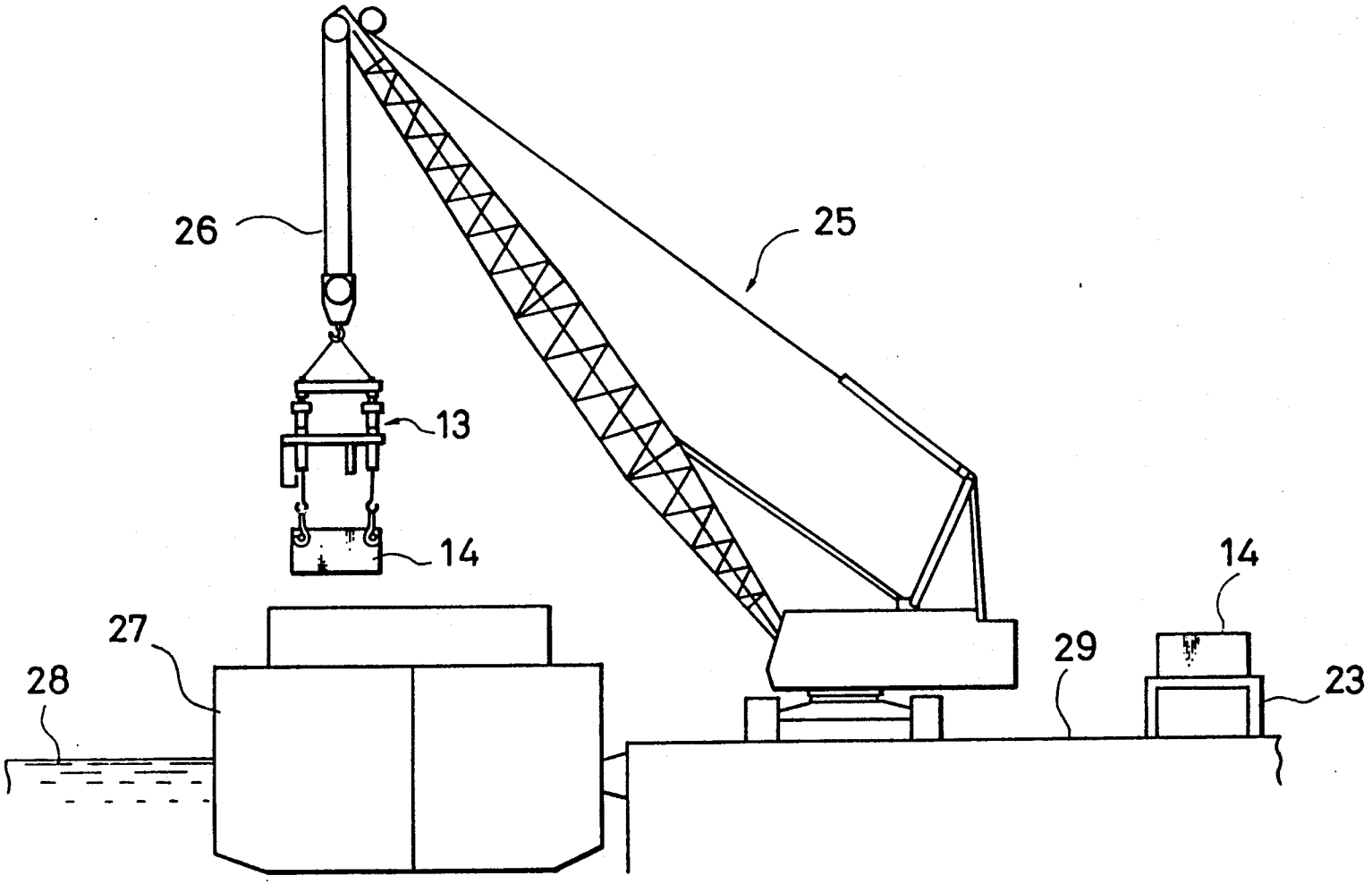
FIG. 7 is a front elevational view of the ship cargo gear during cargo handling on a pier.
Figure 8A:
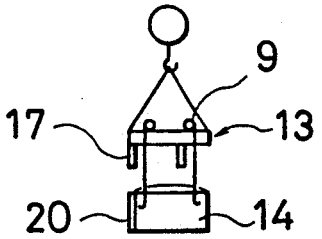
FIGS. 8*a* to 8*j* are illustrations of steps of the cargo handling work.
Figure 8B:
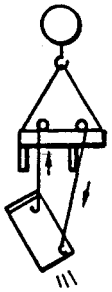
Figure 8C:
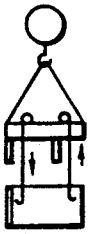
Figure 8D:
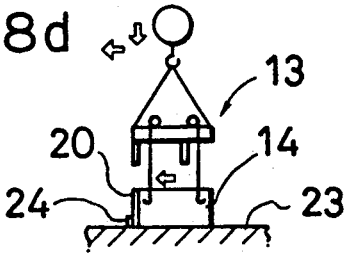
Figure 8E:
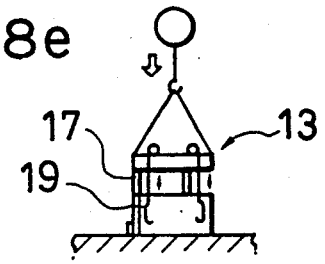
Figure 8F:
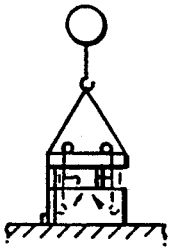
Figure 8G:
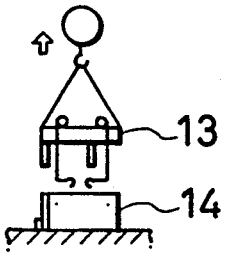
Figure 8H:
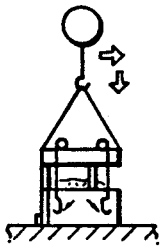
Figure 8I:
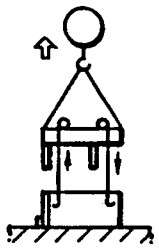
Figure 8J:
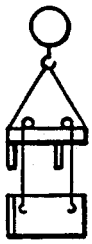

A description will now be given of the process of cargo handling by the described ship cargo gear, with specific reference to FIGS. 7 and 8. FIG. 7 is a front elevational view of the cargo gear on a pier during cargo handling for a ship which is alongside the pier. The suspension gear is suspended from a crane 25 through a wire 26, and the cargo receptacle 14 is suspended from the suspension gear 13. Numeral 27 denotes a ship, 28 denotes sea surface and 29 denotes the pier. The crane 25 swivels to deliver the cargo from the pallet 23 to the ship 27 or vice versa.

Steps of the cargo handling operation will be described with reference to FIG. 8. FIG. 8(*a*) shows a step which corresponds to the state shown in FIG. 7. Namely, the cargo receptacle 14 has been moved to a position above the ship 27. In this state, independent chain blocks 9 are suitably operated to tilt the cargo receptacle 14 as shown in FIG. 8(*b*) so that the content, e.g., scrap pieces, is discharged into a ship'shull. Subsequently, the chain blocks 9 are operated to reset the cargo receptacle to horizontal position, as shown in FIG. 8(*c*). Then, the crane 25 swivels to return the cargo receptacle 14 to a position above the pallet 23 on the pier 29. Then, as shown in FIG. 8(*d*), the crane 25 is operated to bring the box guide 20 of the cargo receptacle 14 into engagement with the stopper guide 24 on the pallet 23 so as to locate the cargo receptacle 14 and then the cargo receptacle 14 is lowered onto the pallet 23. The crane 25 further lowers the suspension gear 13 to bring the supporting post 17 into contact with the upper face of the cargo receptacle vessel 14. In this state, as shown in FIG. 8(*e*), the hook portion 1 is downwardly spaced from the trunnion 19. Subsequently, the chain blocks 9 are operated to lift the support 6 without moving the frame 10, as shown in FIG. 8(*f*), so that each hook member rotates in the same manner as that described before in connection with the hooking apparatus. Then, the suspension gear 13 is lifted and moved to the position above the cargo receptacle 14 by the crane as shown in FIG. 8(*g*). Subsequently, the suspension gear 13 is lowered as shown in FIG. 8(*h*) so as to bring the supporting column 17 into contact with the top of the cargo receptacle. The suspension gear 13 is correctly located with respect to the cargo receptacle 14 by virtue of the cooperation between the suspension gear guide 18 and the box guide 20. Then, the chain blocks 9 are operated to lower the hook member so that the latter is rotated by the force of gravity to a position where the hook portion 1 is suspended upright as described before. Then, the crane 25 operates to lift the suspension gear 13, so that the hook members engage with the trunnions to lift the cargo receptacle as shown in FIG. 8(*i*). The cargo receptacle 14 is then lifted and conveyed as shown in FIG. 8(*j*) to a position above the ship as shown in FIG. 8(*a*). The described operation is repeated for successive batches of cargo.

It will be seen that the automatic hooking apparatus of the present invention automatically hooks and unhooks a cargo very easily.

The ship cargo gear of the present invention remarkably improves the efficiency of the cargo handling work by virtue of the use of the large-size cargo receptacle and automatic hooking apparatus described above. Since there is no need for discharging the cargo such as iron scrap pieces onto the pier, the work can be done in an improved working condition without generation of dust.

What is claimed is:

1. An automatic hooking apparatus, comprising: a hook portion, an arm portion integrally extending obliquely rearward from a base portion of said hook portion; a support to which the base portion of said hook portion is rotatably secured through a shaft, said support being adapted to be moved up and down by a lifting means; a guide secured to a frame and adapted for guiding said support during movement of said support up and down; and an arm guide adapted to be contacted by the end of said arm portion when said arm portion is moved upward together with said support moving upward along said guide, said arm guide being adapted to guide said end of said arm portion substantially horizontally so as to cause said arm portion to rotate about said shaft during further upward movement of said support.

2. A ship cargo gear, comprising: a cargo receptacle capable of holding heavy cargo and having at least four trunnions; and a suspension gear for suspending and lifting said cargo receptacle; wherein said suspension gear includes, for each of said trunnions: a hook portion, an arm portion integrally extending obliquely rearward from a base portion of said hook portion; a support to which the base portion of said hook portion is rotatably secured through a shaft; a lfting means for causing said support to move up and down; a guide secured to a frame of said suspension gear and adapted for guiding said support during movement of said support up and down; and an arm guide adapted to be contacted by the end of said arm portion when said arm portion is moved upward together with said support moving upward along said guide, said arm guide being adapted to guide said end of said arm portion substantially horizontally so as to cause said arm portion to rotate about said shaft during further upward movement of said support.

* * * * *